United States Patent [19]

Wade

[11] 4,351,117

[45] Sep. 28, 1982

[54] DRAWING BOARD APPARATUS

[76] Inventor: Earl R. Wade, 14912 E. Truman Rd., Independence, Mo. 64050

[21] Appl. No.: 224,888

[22] Filed: Jan. 14, 1981

[51] Int. Cl.[3] ..... B43L 13/02

[52] U.S. Cl. ..... 33/435; 33/454

[58] Field of Search ..... 33/435, 443, 446, 447, 33/454, 430, 431–434

[56] References Cited

U.S. PATENT DOCUMENTS

| | | | |
|---|---|---|---|
| 907 | 9/1838 | Steiger | 33/435 |
| 278,010 | 5/1883 | Hanstein | 33/430 |
| 389,472 | 9/1888 | Hopkins | 33/435 |
| 1,440,993 | 1/1923 | Hasbrouck et al. | 33/435 X |
| 2,073,881 | 3/1937 | Ronnquist | 33/443 |
| 2,394,619 | 2/1946 | Lenz | 33/454 |
| 2,415,277 | 2/1947 | Caston | 33/435 |
| 2,855,721 | 10/1958 | Shelly | 33/435 X |
| 3,526,963 | 9/1970 | Cansmith | 33/454 |

*Primary Examiner*—Harry N. Haroian

*Attorney, Agent, or Firm*—Litman, Day and McMahon

[57] ABSTRACT

A drawing apparatus includes a base member of rectangular form with front, rear and opposite side margins and an upper surface with a compass rose plate for affixing a drawing sheet thereon and pivotally mounted to the base member upper surface. A carriage frame is positioned generally on the upper surface of the base member and has spaced guide members slidably mounted to the base member side margins and interconnected by a crossbar for coordinated translatory movement. A parallel rule structure is supported by the carriage frame and has first and second drawing bars and first and second links forming an expansible and contractible parallelogram generally positioned atop the compass rose plate. The links are respectively mounted to the spaced guide members of the carriage frame for sliding movement therewith over the compass rose plate and for positioning the parallelogram rule structure at selected locations thereon.

9 Claims, 11 Drawing Figures

DRAWING BOARD APPARATUS

BACKGROUND OF THE INVENTION

In drafting, the speed and accuracy of representation are of the essence. The practice of reducing or enlarging an article in size for representation, or scaling off, is often particularly time-consuming. In drafting, a plurality of lines of angular relationship must often be drawn, such as with the usual protractor or other such drafting aids. Often, a great many parallel lines equidistant from a center point must be drawn. The established procedures of measuring to and from a center point and drawing lines spaced equidistantly therefrom are time-consuming and subject to error.

The principal objects of the present invention are: to provide a drawing apparatus having a compass rose plate therewith for establishing angular relationships; to provide such a drawing apparatus having means therewith for scaling off; to provide such a drafting apparatus having parallel rule means therewith for establishing parallel lines; to provide such a drawing apparatus having measurement scales therewith to determine the linear distance from a center point of equidistant lines; to provide such a drawing apparatus having an expansible and contractible parallelogram structure positioned atop a compass rose plate; to provide such a drawing apparatus having a carriage frame therewith supporting an expansible and contractible parallelogram structure for selective placement of the parallelogram structure over portions of a compass rose plate; to provide a drawing apparatus having a plurality of drafting aids adapted for use with the drawing apparatus; to provide such a drawing apparatus which may be disassembled and quickly reassembled; to provide such a drawing apparatus which may be easily adjusted to accomodate different thicknesses of drawing paper; and to provide such a drawing apparatus which is relatively inexpensive, sturdy and efficient in use, and particularly well adapted for the intended purpose.

Other objects and advantages of this invention will become apparent from the following description taken in connection with the accompanying drawings, wherein are set forth, by way of illustration and example, certain embodiments of this invention.

Figure 1:
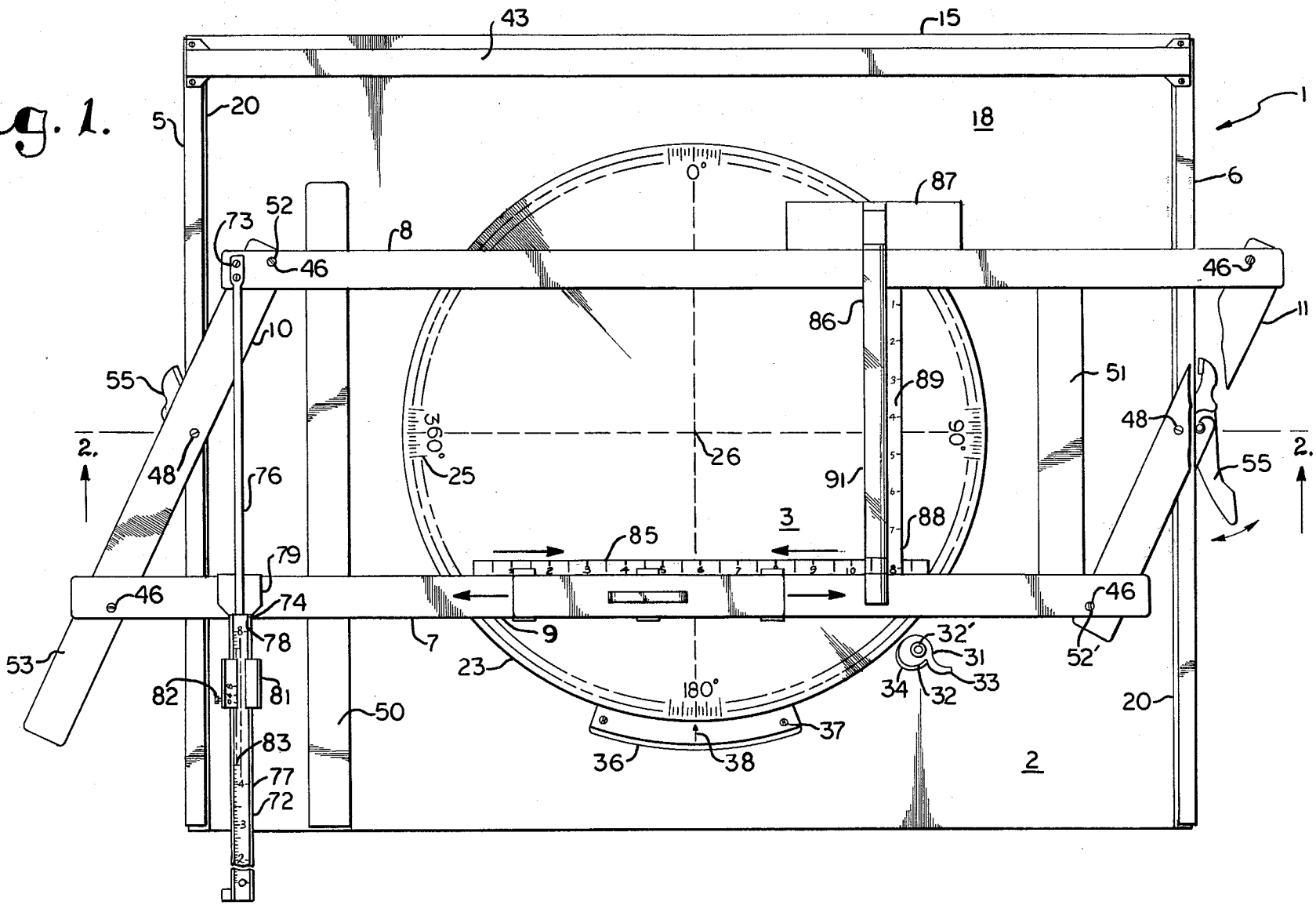
FIG. 1 is a top plan view of the drawing apparatus embodying the present invention.

As required, a detailed embodiment of the present invention is disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally indicates a drafting apparatus embodying the present invention. The apparatus includes a base member 2 with a compass rose plate 3 pivotally mounted on an upper surface thereof. A carriage frame 4 is also positioned atop the base member 2 and has spaced guide members 5 and 6 slidably mounted to the side margins of the base member 2. A parallel rule structure 7 is pivotally mounted to the carriage frame 4 and has first and second drawing rules such as bars 8 and 9 and links 10 and 11 forming an expansible and collapsible parallelogram generally positioned over the compass rose plate 3. The links 10 and 11 are pivotally mounted to the spaced guide members 5 and 6 and travel with the guide members over the compass rose plate 3.

Figure 5:
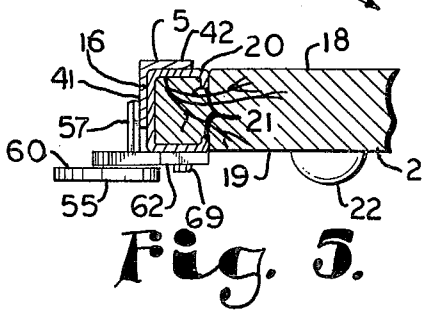
FIG. 5 is a fragmentary end view of a side of the drawing apparatus showing a stop means or locking device connected thereto.
Figure 7:
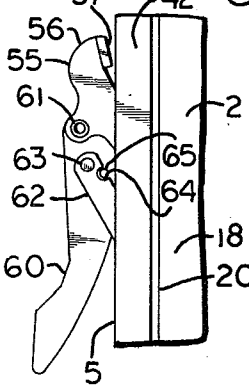
FIG. 7 is a fragmentary, top view of the side locking device.

In the illustrated example, the base member 2 is planar, rectangular in shape and has front and rear margins 14 and 15, opposite side margins 16 and 17 and upper and lower surfaces 18 and 19. The side margins 16 and 17 have protecting channel members 20 extending therealong, FIG. 5, with inturned ends 21 pressed or otherwise buried within the material of the base member 2. In the illustrated example, the base member 2 is of wood and the channel members 20 of metal along the side margins 16 and 17 provide smooth, warp-free surfaces for coordination with drafting tools. Feet 22, as of rubber or the like non-skid material, extend downwardly from the lower surface 18.

Figures 2, 3:
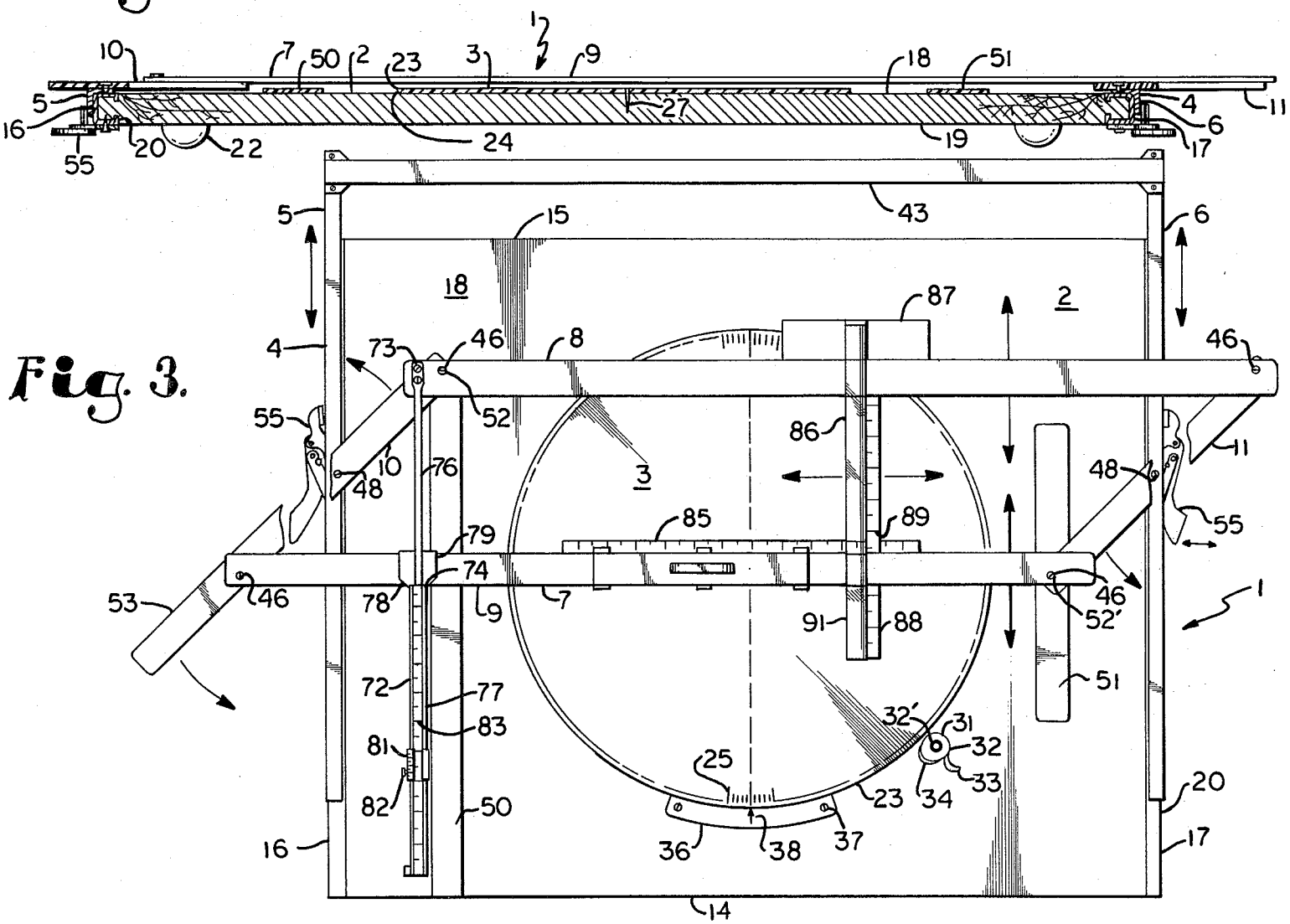
FIG. 2 is a transverse, sectional view taken along lines 2—2, FIG. 1.
FIG. 3 is a top plan view of the drawing apparatus and reduced in scale from FIG. 1, and showing details of use thereof.

The compass rose plate 3 is circular in shape with an outer perimeter or margin 23 having, in the illustrated example, a circumferential groove 24 therearound, FIG. 2. Degree indicia 25 extend about the outer margin 23 and full 360° thereof and indicate azimuth from a central axis 26, FIG. 1. The compass rose plate 3 is pivotally and axially mounted to the base member 2 on the upper surface 18 thereof by a pivot pin 27 extending into the base member 2. The upper surface of the compass rose plate 3 is adapted for affixing, as by taping or the like, a sheet of drawing paper 29 thereon, FIG. 4, whereby the drawing paper can be rotated with the compass rose plate 3 to selected angular positions.

Rotation of the compass rose plate 3 relative to the base member 2 may be effected directly manually or by manipulation of remotely located motive means (not shown).

A compass rose plate stop means 31 selectively prevents relative movement between the compass rose plate 3 and the base member 2 and, in the illustrated example, includes a cam member 32 pivotally mounted to the base member 2 by a pivot pin 32' adjacent the outer perimeter or margin 23 of the compass rose plate 3 and having a finger 33 adapted for grasping and rotating the cam member 32 snugly against the outer perimeter or margin 23. The cam member 32 includes a circumference tongue 34 of increasing outward cam angle which wedges in the compass rose plate circumferential groove 24 to secure same against inadvertent rotation. Preferably, the cam member 32 is of a height not to exceed the height of the compass rose plate 3 above the base member 2 to enable the parallel rule structure 7 to be moved thereover without interference.

An azimuth marker 36 is mounted on the base member upper surface 18 adjacent the outer perimeter or margin 23 of the compass rose plate 3 for indicating a degree of rotation relative to the parallel rule structure 7 and to the base member 2. In the illustrated example, the marker 36 is a relatively short member arranged in an arc segment and having fasteners 37 securing same to the base member 2. An indicia 38 on the marker 36 aligns with a selected compass rose plate degree indicia 25 to indicate azimuth.

The carriage frame 4 of metal, plastic or the like is mounted to the base member 2 and supports the parallel rule structure 7. In the illustrated example, the guide members 5 and 6 respectively extend substantially the length of the base member side margins 16 and 17 and are angle members, FIG. 5, with a web portion 41 positioned against the channel members 20 overlying the respective side margins 16 and 17 and an outwardly extended upper flange portion 42 respectively on the base member upper surface 18 adjacent the respective side margins 16 and 17. The channel members 20 provide metal to metal contact with the guide members 5 and 6 for smooth sliding thereof. A crossbar member 43 extends between respective rear ends 44 of the guide members 5 and 6 for coordinated translatory movement thereof and provides restriction against spreading of the guide members 5 and 6.

The parallel rule structure 7 includes the first and second drawing rules such as bars 8 and 9 which are each of a length generally the same as the length of the base member 2 between the side margins 16 and 17. Preferably, the drawing bars 8 and 9 are of a warpage resistant material such as metal or plastic to provide a straight edge for a draftsman to draw along a top edge or margin thereof. The drawing bars 8 and 9 are interconnected by the links 10 and 11 to form a parallelogram structure. The links 10 and 11 are respectively positioned at the opposite ends of the first and second drawing bars 8 and 9 and pivotally connected thereto by pivot pins 46 that extend through the respective drawing bars 8 and 9 and the accompanying links 10 and 11 to enable the parallel rule structure 7 to selectively collapse and expand, FIGS. 1, 3 and 4. During the expanse and collapse of the parallel rule structure, the first and second drawing bars 8 and 9 move relative to a selected center line at an equal rate. Thus, when the parallel rule structure 7 is fully collapsed to form a narrow line or slot between the drawing bars 8 and 9 coextensive with the selected center line, the drawing bars 8 and 9 can be moved by expanding the parallel rule structure 7 whereby the drawing bars 8 and 9 maintain equidistant relationships to the selected center line. Thus, parallel lines of equidistant relationship to a selected center line are easily formed as are parallel lines equidistant from a horizontal plane through the axis 26.

The respective links 10 and 11 are pivotally affixed to the guide members 5 and 6 as by pivot pins 48 which are positioned so that the drawing bars 8 and 9 extend parallel to the front and rear margins 14 and 15 and establish a drafting horizontal or X-axis for the base member 2.

To establish and maintain the first and second drawing bars 8 and 9 in a slightly spaced relationship to the upper surface of the compass rose plate 3, skid members 50 and 51 are affixed to the base member upper surface 18 on opposite sides of the compass rose plate 3 and spaced from the side margins 16 and 17. The skid members 50 and 51 generally slidably engage the lower surface of the links 10 and 11 at respective upper left corner and lower right corner pivot points 52 and 52'.

Figure 4:
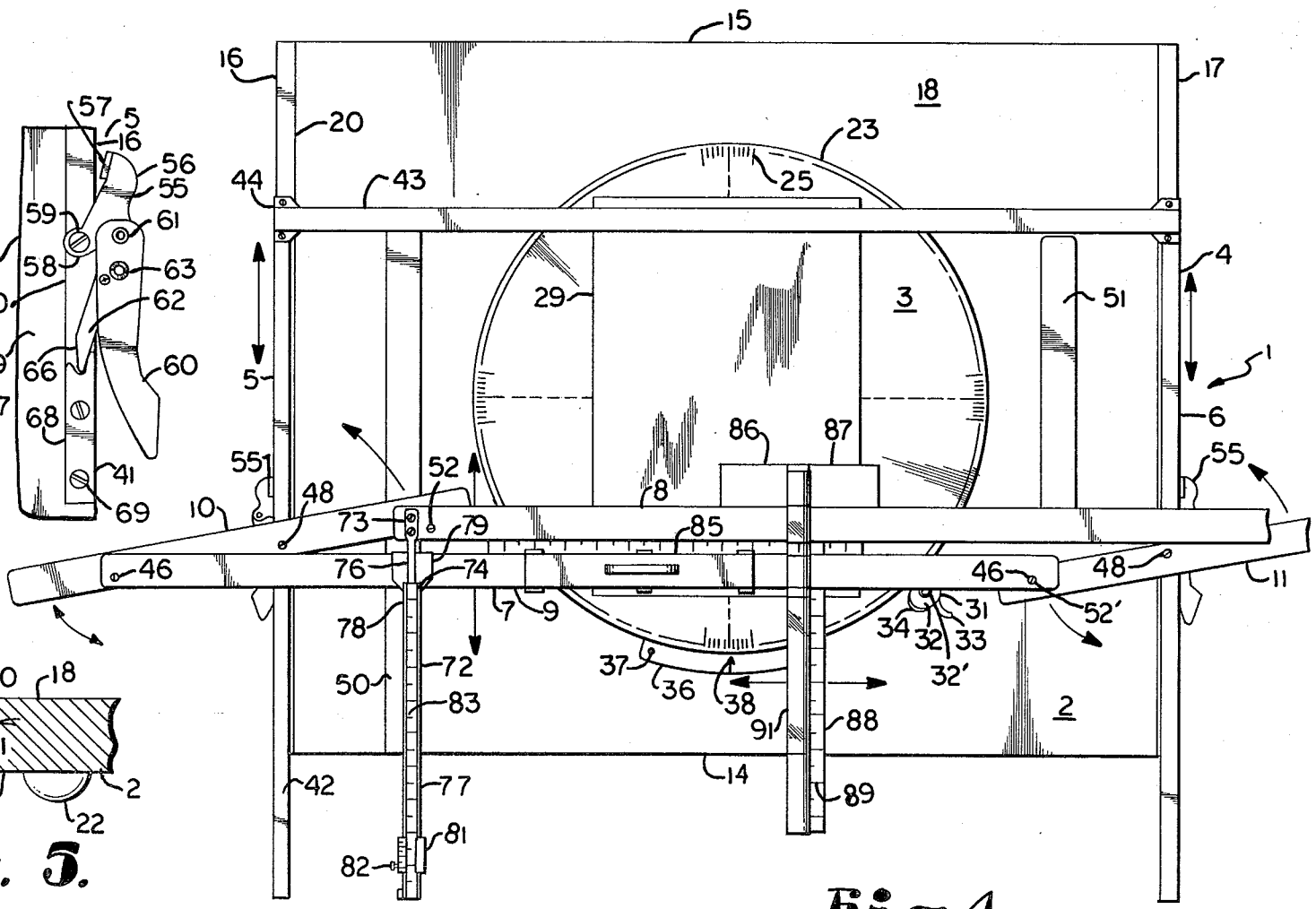
FIG. 4 is a top plan view of the drawing apparatus showing further details of use thereof.
Figure 6:
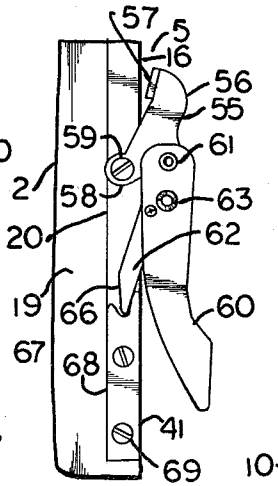
FIG. 6 is a fragmentary, bottom view of the side locking device.

To aid in expanding and collapsing the parallel rule structure 7, the link 10 includes an outwardly extending end forming a handle 53 for grasping and rotating, as indicated by the arrows, FIGS. 3 and 4. Movement of the handle 53 toward the rear margin 15 causes the parallel structure 7 to collapse. Conversely, movement of the handle 53 toward the front margin 14 causes the parallel rule structure 7 to expand.

To lock the carriage frame 4 at a selected position, the drawing apparatus 1 includes a guide member lock or stop means 55 extending between the carriage frame 4 and the base member 2. In the illustrated example, each guide member stop means 55 includes a head portion 56 having a face 57 for engagement with the guide member web portion 41 and with a remote end 58 pivotally mounted to the base member lower surface 19 adjacent the respective side margin 16 or 17 by a pivot fastener 59. An intermediate portion of the head portion 56 is pivotally affixed to a lever arm 60 adapted for grasping and mounted by a pivot pin 61. An intermediate portion of the lever arm 60 is pivotally affixed to a wedging link 62 by a pivot pin 63, said wedging link 62 including a recess 67 of an abutment plate 68 secured by fasteners 69 to the base member lower surface 19 adjacent the side margins 16 or 17.

The guide member stop means 55 acts as an over-center cam lock wherein inward pressure on the lever arm 60 urges the remote end 66 of the wedging link 62 into snug engagement in the abutment plate recess 67 with the length dimension of the wedging link 62 proportioned to be jammed into the recess 67 when the lever arm stop 65 is received within the wedging link recess 64, thereby locking the head portion 56 into a position lodged against the guide member web portion 41.

In the illustrated example, a rule means 72 extends perpendicularly between the first and second drawing bars 8 and 9 and has one end 73 affixed to one of the drawing bars 8 and 9 and another end 74 slidably mounted to the other of the drawing bars 8 or 9. In the illustrated example, the rule means 72 is of the vernier scale type and has an elongate telescoping member 76 receivable within an underside groove (not shown) of an elongate scale bar 77. An upper end 78 of the scale bar 77 is affixed to the second drawing bar 9 by a hanger 79 having an edge portion engaging a margin of the second drawing bar 9. The lower end of the telescoping member 76 is affixed to a traveling block member 81 which slides along the scale bar 77 and has a set screw 82 extending through one side thereof. The set screw 82 selectively locks the telescoping member 76 to the scale bar 77 and thereby prevents relative movement of the first and second drawing bars 8 and 9 or expansion and collapse of the parallel rule structure 7. Preferably, scale indicia 83 on the scale bar 77 and the traveling block member 81 are positioned to provide a direct reading of the distance between the top drawing margins or edges of the first and second drawing bars 8 and 9.

Also providing a scale for measurement, a scale strip 85 is affixed to the second drawing bar 9. A drawing aid such as a T-square 86 is proportioned for use with the drawing bars 8 and 9 to establish a drafting vertical or Y-axis. In the illustrated example, the T-square 86 has a head 87 orthogonally affixed to a lower bar member 88 which has scale indicia 89 thereon. The lower bar member 88 is positioned in use between the upper surface of the compass rose plate 3 and the lower surface of the drawing bars 8 and 9. To maintain the lower bar member 88 from contact with the drawing paper 29 which may tend to smudge a drawing thereon, an upper support member is affixed to the head 87 and extends over the drawing bars 8 and 9. In the illustrated example, the upper support member 91 is of transparent plastic material of convex shape to provide a magnification, as at 92 of the scale strip 85.

Additional drafting aids can be employed with drawing apparatus 1 and may include such devices as triangles adapted to fit between the drawing bars 8 and 9, auxiliary straight edges, chamfer edge guides and the like (not shown).

In the use of the drawing apparatus 1, the drawing paper 29 is positioned upon the upper surface of the compass rose plate 3 and affixed thereto, as by tape, adhesive or the like. The drawing apparatus 1 is particularly useful for drawing parts to be formed by machine turning such as armatures, motor shafts and the like. These articles are symmetrical in form and have lines spaced equidistantly from a point or center axis. The point or line of symmetry may be a plane through the compass rose plate pivot axis 26 or may be a point or line of symmetry on the compass rose plate 3 displaced from the pivot axis 26 and selected by moving of the carriage frame 4 upwardly or downwardly as desired on the base member 2. To move the carriage frame 4, the guide member stop means 55 are released by grasping and rotating the lever arms 60 outwardly to release the respective head portions 56 away from engagement with the respective guide member web portions 41. The carriage frame 4 is then slid upwardly and downwardly as desired to select a new center line. Once in the desired position, the carriage frame 4 is locked relative to the compass rose plate 3 by rotating the respective lever arms 60 inwardly to urge the head portions 56 inwardly.

Additionally, angles can be quickly and easily selected without need of a protractor by releasing the cam member 32 of the compass rose plate stop means 31, rotating the compass rose plate 3 to a selected position as indicated by alignment of a selected degree indicia 25 and the marker indicia 38 and relocking the cam member 32. Lines equidistantly spaced from a selected point are made by grasping and rotating the handle 53 to expand or collapse the parallel rule structure 7 as desired. The amount of distance along the vertical or Y-axis is measured on the rule means 72.

An alternative embodiment of the drawing apparatus 1 is shown in connection with FIGS. 8 through 11 with substantially like parts identified by the numerals utilized in connection with FIGS. 1 through 7. In the alternate embodiment apparatus, the parallel rule structure 7 is pivotally mounted to the guide members 5 and 6 by hangers 100 which suspend the rule structure 7 a slight distance above the upper surface of the compass rose plate 3. In this manner, clearance of the bars 8 and 9 from drawing paper affixed to the plate 3 is provided to prevent unsightly smudges and smears.

The hangers 100 respectively include an inverted L-shaped portion 101 having one leg 102 connected to the web portion 41. The other leg 103 extends over the upper flange portion 42 in spaced relation and an arm 104 is connected thereto, as by rivets 105. A remote end of the respective arms 104 pivotally supports a respective link 10 or 11 by the pivot pin 48 so that the parallel rule structure 7 is expansible and collapsible as described above.

Figure 9:
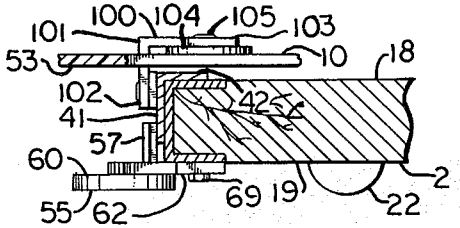
FIG. 9 is a fragmentary end view of a side of the alternately embodied drawing apparatus showing a stop means or locking device connected thereto.

The alternate embodiment of the drawing apparatus 1 includes the stop means 55 as described above with the exception that the face 57 of the head 56 is shorter in height to accomodate the leg 102, FIG. 9.

The alternate embodiment of the drawing apparatus 1 includes a dial scale 110 with the rule means 72 and mounted in a conventional manner to the traveling block member 81.

Figure 8:
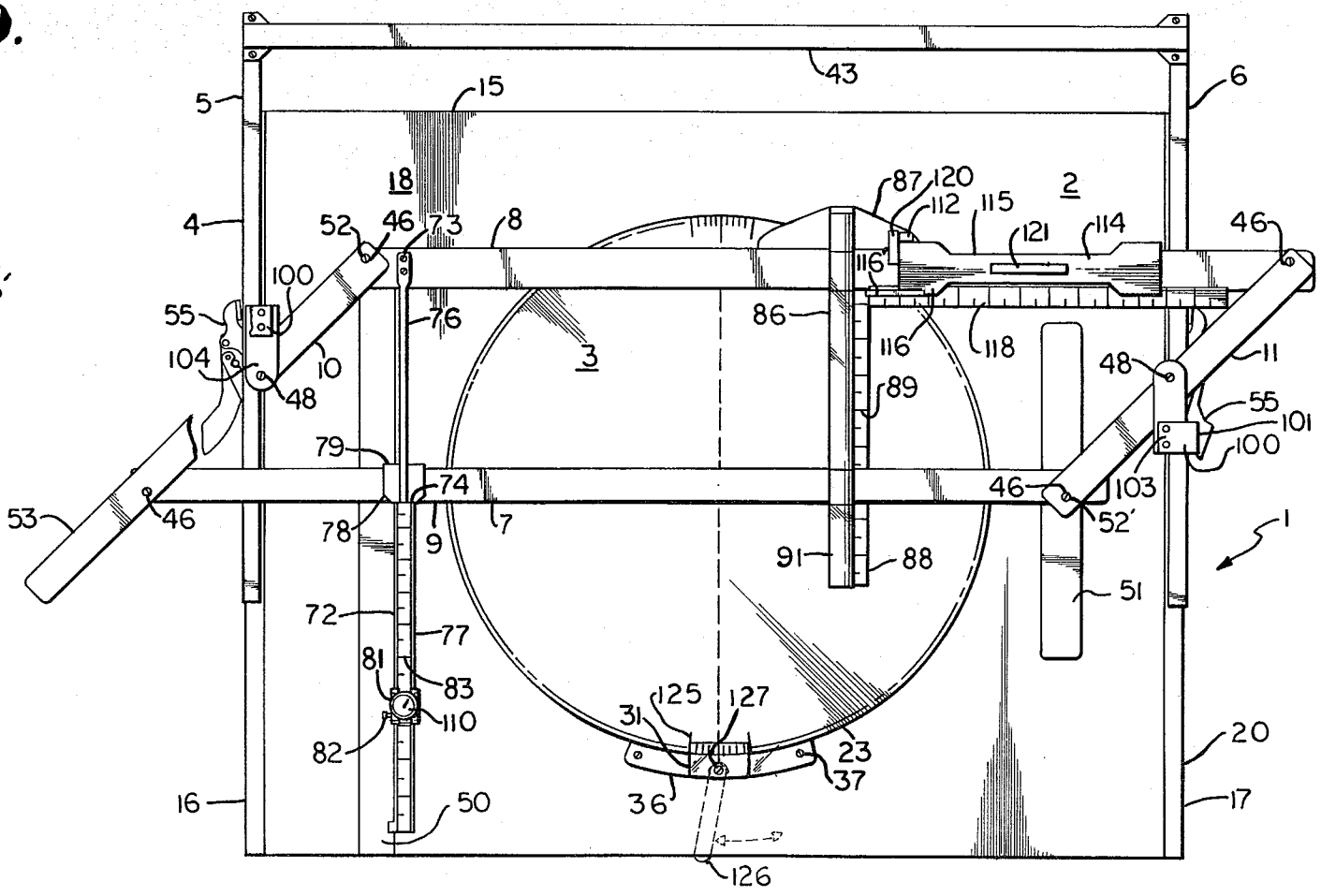
FIG. 8 is a top plan view of an alternative embodiment of the drawing apparatus.
Figure 10:
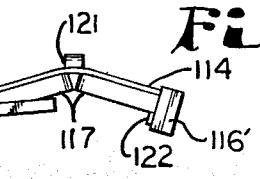
FIG. 10 is an enlarged, side elevational view of a scale holder device for use with the drawing apparatus.
Figure 11:
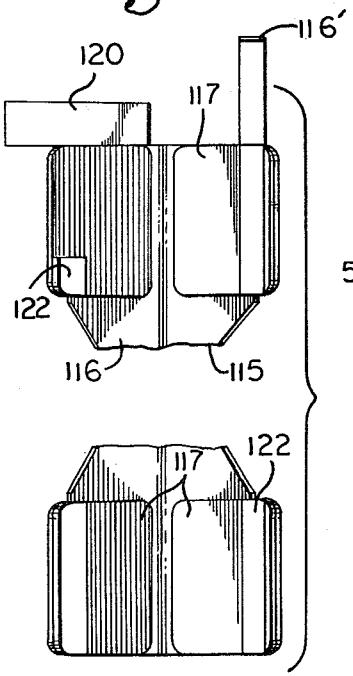
FIG. 11 is an enlarged, fragmentary, bottom view of the scale holder device.

The T-square 86 shown in connection with FIG. 8 includes a block portion 112 on an end of the head 87 thereof or engagement with mutual locking portions of a scale support 114, FIGS. 8, 10 and 11. The scale support 114 includes an elongate central bar portion 115 and opposite head ends 116, each bent laterally so as to cup over the drawing bar 8. In the illustrated example, the opposite head ends 116 have magnets 117 affixed to the underside thereof which ride upon preferably nonmagnetic material of the bar 8. A steel rule 118 is magnetically affixed to the magnets 117 in spaced relation to the central bar portion 115. The head ends 116 laterally overhang the bar 8, FIG. 8, so that the rule 118 is supported alongside the bar 8 for measuring distances as described above. A stop arm 116' extends from one of the head ends 116 to establish proper positioning of the rule 118 and prevent overriding of the vertical scale.

For coordinated movement of the scale support 114 with the T-square 86, an arm 120 is mounted to the head end 116 adjacent the T-square head 87 and interlocks with the block portion 112 so that the scale support 114 is pulled with the T-square 86, as during movement to the left, FIG. 8. One end of the rule 118 abuts the T-square lower bar member 88 so that the scale support 114 is pushed with the T-square 86, as during movement to the right. A handle 121 facilitates manipulation and spaced guides 122 suitably grip the edges of the bar 8.

FIG. 8 shows an alternate embodiment of compass rose plate stop means 31 which includes an upper jaw portion 125 atop the marker 36 and having a plurality of azimuth markings thereon. An arm member 126 extends under the base member 2 and has one end secured to a lock pin 127 which extends upwardly through the base member 2 and the marker 36 and connects to the jaw portion 125. Upon rotation of the arm member 126, as indicated by the arrow, FIG. 8, the jaw portion 125 is pulled downwardly into tight engagement against the rim of the compass rose plate 3, thereby preventing rotation thereof.

For aid in applying a smooth, straight line, the drawing bars 8 and 9 may be provided with tapered, plastic edge portions and the like (not shown).

It is to be understood that while one form of this invention has been illustrated and described, it is not to be limited to the specific form or arrangement of parts described and shown, except insofar as such limitations are included in the following claims.

What is claimed and desired to secure by Letters Patent is:

1. A drawing apparatus comprising:
(a) a base member having opposite side margins;
(b) a compass rose plate pivotally mounted to said base member between said side margins;
(c) a carriage frame having spaced guide members slidably mounted to said side margins; and
(d) a parallel rule structure having first and second drawing bars and links pivotally mounted thereto and forming an expansible and collapsible parallelogram generally positioned atop said compass rose plate, said links being pivotally mounted to said spaced guide members for sliding movement therewith over said compass rose plate.

2. The drawing apparatus set forth in claim 1 including:
(a) a rule means extending perpendicularly between said drawing bars and having one end affixed to one of said drawing bars and another end thereof slidably mounted to the other of said drawing bars;
(b) said rule means having scale indicia thereon indicating the lateral distance between said drawing bars.

3. The drawing apparatus set forth in claim 1 wherein:
(a) said drawing bars respectively have first and second ends and said links are respectively pivotally mounted to and connect said drawing bars and said first and second ends; and
(b) one of said links has a handle extending outwardly thereof adapted for grasping for expanding and collapsing said parallelogram.

4. The drawing apparatus set forth in claim 1 wherein:
(a) said compass rose plate has an outer perimeter margin; and including
(b) a compass rose plate stop means comprising a cam member pivotally mounted adjacent said compass rose plate and having a finger thereon for grasping and rotating said cam member snugly against said outer perimeter margin.

5. The drawing apparatus set forth in claim 1 wherein:
(a) said base member has upper and lower surfaces;
(b) said guide members are angle members with a web portion positioned against said respective said side margins and an outwardly extended upper flange portion respectively gripping said upper surfaces.

6. The drawing apparatus set forth in claim 5 including:
(a) guide member stop means extending between said guide members and said base member;
(b) said guide member stop means including a head pivotally mounted to a lever arm pivotally secured to said base member lower surface, said lever arm being actuable to urge said head into engagement with said web portion of said guide members and stop relative movement between said guide members and said base member.

7. The drawing apparatus set forth in claim 1 including:
(a) spaced skid members affixed to said base member and positioned on opposite sides of said compass rose plate;
(b) said parallel rule structure slidably contacting said skid members;
(c) said skid members extending above said base member a distance sufficient to space said parallel rule structure in non-contacting relationship with said compass rose plate.

8. A drawing apparatus comprising:
(a) a base member of rectangular form with front, rear and opposite side margins and an upper surface;
(b) a compass rose plate for affixing a drawing sheet thereon pivotally mounted to said base member on said upper surface;
(c) a marker mounted on said upper surface adjacent said compass rose plate for indicating the degree of relative rotation thereof;
(d) compass rose plate stop means mounted to said base member and selectively engaging said compass rose plate to stop the relative rotation thereof;
(e) a carriage frame having spaced guide members slidably mounted to the side margins of said base member and with said guide members interconnected by a crossbar member for coordinated translation thereof on said base member;
(f) a guide member stop means extending between said carriage frame and said base member; and
(g) a parallel rule structure having first and second drawing bars and first and second links forming a selectively expansible and collapsible parallelogram generally positioned atop said compass rose plate, said links being respectively pivotally mounted to said spaced guide members for sliding movement therewith over said compass rose plate.

9. The drawing apparatus set forth in claim 8 including:
(a) spaced, elongate skid members extending outwardly of said base member upper surface, on opposite sides of said compass rose plate and generally parallel to said side margins;
(b) said skid members extending above said upper surface a height sufficient to slidably support said parallel rule structure in spaced relationship above said compass rose plate for interference-free movement thereover.

* * * * *